United States Patent [19]

Berlet

[11] 4,145,793

[45] Mar. 27, 1979

[54] CLOTHESPIN

[76] Inventor: Edward Berlet, 9 Adrian Ave., Apt. 5B, Bronx, N.Y. 10463

[21] Appl. No.: 916,871

[22] Filed: Jun. 19, 1978

[51] Int. Cl.[2] ..... A44B 21/00

[52] U.S. Cl. ..... 24/137 A

[58] Field of Search ..... 24/137 R, 137 A, 138, 24/252 R

[56] References Cited

U.S. PATENT DOCUMENTS

| | | | |
|---|---|---|---|
| 2,409,379 | 10/1946 | Mosaly | 24/137 A |
| 2,475,436 | 7/1949 | Roark | 24/137 A |
| 2,492,069 | 12/1949 | Stinne | 24/137 A |
| 2,922,204 | 1/1960 | Longhi | 24/137 A |
| 4,063,333 | 12/1977 | Schweitzer | 24/137 A |

*Primary Examiner*—Philip C. Kannan

*Attorney, Agent, or Firm*—McAulay, Fields, Fisher & Goldstein

[57] ABSTRACT

A clothespin with two elongated members each having a forward end defining a gripping portion and a centrally disposed pivot portion about which each elongated member pivots. A spring acts to bias the gripping portions into abutment with each other and to hold the elongated members together. To further restrain the sliding of one elongated member with respect to the other, a key and groove locking mechanism is provided forward of the pivot portion, whereby the locking mechanism will operate with a minimum of wear due to pivoting forces generated in the operation of the clothespin.

4 Claims, 5 Drawing Figures

CLOTHESPIN

BACKGROUND OF THE INVENTION

Various clothespin devices are generally familiar to most people and a number of these devices are the subject of patents issued in the United States.

Perhaps the most familiar clothespin device is the clothespin normally made of wood with a coiled spring pivot having ends extending outside of the clothespin to press the forward jaws of the clothespin together. As anyone who has used such clothespins will attest, these clothespins often twist apart either when compressed prior to use, or while employed as a clamp, thereby becoming useless. Often the various parts of the clothespin will merely twist with respect to each other and require realignment, sometimes they will literally fly apart while being used to clamp clothes to a line.

A number of devices attempting to improve on the basic clothespin, have been devised and are the subject of several U.S. patents. For example:

U.S. Pat. No. 2,475,436 to Roark for a "Clothespin" shows a structure wherein a rectangular shaped wire spring is woven around a clothespin with an open edge near the forward end of the clothespin. The clothespin is pivoted on a transverse ridge formed on one arm of the clothespin, which fits into a transverse raised socket formed on the other arm of the clothespin. The spring member extends out of the rear of the clothespin and travels along the outside of the clothespin body to return back into the clothespin at the forward end. The spring acts to directly press the jaws of the clothespin together. This type of clothespin construction has a number of problems. Although the arms of the clothespin will tend to remain aligned, there is wear on the spring and clothespin where it enters the rear of the clothespin body and, in addition, the nature of the spring itself is such as to wear out after a relatively short time of use. In addition, the outwardly extending spring presents a possible "catching" problem as a result of contact with clothes or other clothespins.

U.S. Pat. No. 4,063,333 to Schweitzer is a relatively recently issued patent drawn to a clothespin which appears to be a modification of the prior coil spring type of device. A coil spring having two rearwardly extending arms is utilized and it is secured to each elongated member of the clothespin using a clip means. A pin and aperture assembly is shown as improving the stability of the device while preventing contact of the clothes with the spring. As with the prior wooden clothespin type device, the spring in this device also acts as the pivot. Although the spring is generally contained within the device it is exposed on either side even when the pin and aperture guard is utilized. The compression and expansion of the relatively exposed spring can still act to snag material which may not be neatly disposed in the jaws of the device.

The clamping device shown in U.S. Pat. No. 3,456,262 to Coon has a spring with its open end forward to provide a direct closing force to the forward jaws of the clamp. The forward end of the spring conforms to support walls on the jaws which, the Coon patent teaches, allows the use of stronger springs while reducing the probability of cracking the jaws.

It is an object of the present invention to provide a clothespin which will not come out of alignment or fall apart.

It is a further object of the present invention to provide a clothespin which utilizes a flat spring to minimize possible snagging and to help maintain the clothespin in alignment.

It is a related object of the invention to provide a clothespin with a spring which is completely contained within the clothespin and does not extend outside the body of the clothespin. It is a further related object of the invention to provide a clothespin which is convenient to handle without the need for realignment of the parts as a result of haphazard storage or accidental misalignment in use.

It is a still further object of the invention to provide a clothespin which is economical to make and simple in construction while meeting the objects set forth above.

Further objects of the invention will, in part, be set forth in the description below and will, in part, be obvious therefrom.

BRIEF DESCRIPTION OF THE INVENTION

Briefly, a clothespin according to the present invention is of the type having two elongated members or arms and an inner spring operating to press the rear portions of the clothespin apart thereby to bias the forward gripping ends of the clothespin together. Important features of the clothespin include a bridge formed of two bridge portions, one in each arm, which when pressed together form a generally rectangular structure. The flat spring is hair pin in shape with a generally circular, but open, central portion. Extending from each edge of the opening are two arms which diverge from the circular portion. The circular portion of the spring fits around the rectangular bridge and contacts the bridge at four edges, with the spring arms extending rearwardly and upwardly against the inner surface of the rearwardly extending portion of the clothespin arms. When the rear portions of the clothespin arms are pressed together, as is usual in these devices, to open the forward gripping jaws, the diverging arms of the spring are pressed together causing the circular central portion to be deformed about the bridge. This deformation adds to the apparent strength of the spring and causes it to clamp tightly to the bridge when the clothespin jaws are opened.

Elongated recesses are formed in the arms to receive the spring. The width of the spring is approximately coextensive with the width of the recesses so that the edges of the spring are held by abutment with the recess. This is especially important near the bridge where, just behind the center line of the bridge, the edge of the spring is closely spaced to the edge of the recess in which it is received to restrain relative forward and backward motion of the arms with respect to each other. Additionally, it is preferable that the lateral edges of the circular portion of the spring be closely contained to further restrain relative side movement of the arms.

Although the flat spring, which is within the recess formed in the clothespin structure and wrapped about the bridge, acts to maintain the clothespin in alignment, an additional key and groove structure is also provided, forward of the position at which the arms of the clothespin pivot, to maintain the clothespin in alignment. Basically, the key is a projection having flat sides parallel to the elongated sides of the clothespin and a rounded forward and rear portion. This shape can be visualized as the shape a piece of a cylinder would have when the piece is cut from a cylinder by a plane parallel to its elongated axis. This projection fits into a matching groove formed in the other arm of the clothespin. By disposing it just forward of the pivot portion of the clothespin, the device will operate without being subjected to the stresses generated by the pivoting action of the clothespin. The straight side walls keep the arms of the clothespin from twisting or sliding with respect to each other while the rounded forward and rear surfaces allow the projection to ride smoothly into and out of its associated groove as to the clothespin opens and closes.

For better understanding of the device, reference is now made to the drawings and to the following detailed description of the preferred embodiment of the device.

DESCRIPTION OF THE PREFERRED EMBODIMENT

Figure 1:
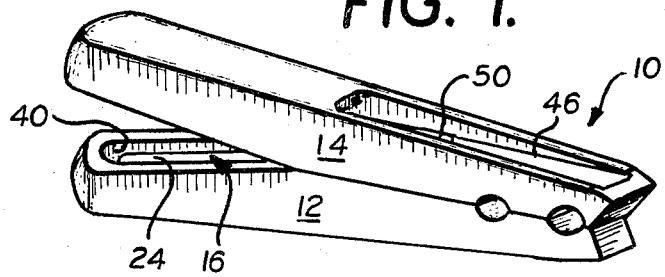
FIG. 1 is a perspective view of a clothespin according to the present invention.
Figure 2:
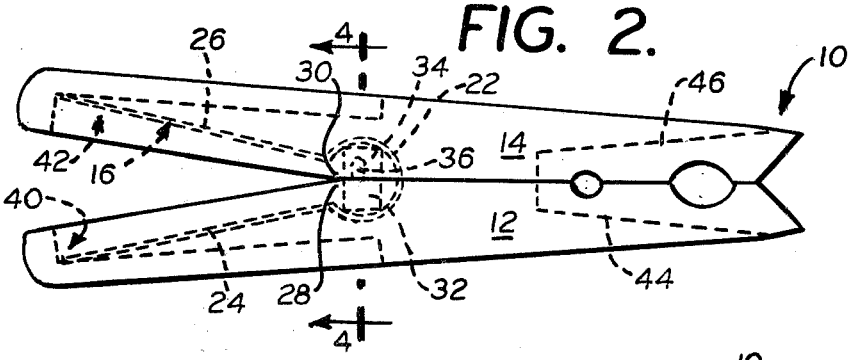
FIG. 2 is an elevational view of the clothespin of FIG. 1 showing, in broken line, the relationship among the various elements.
Figure 3:
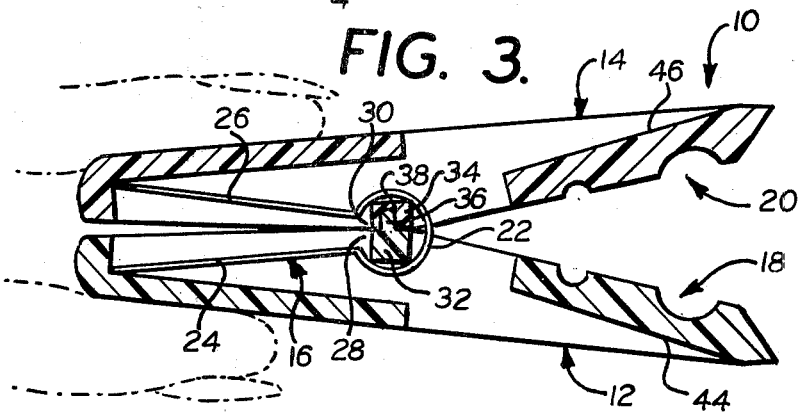
FIG. 3 is similar to FIG. 2 but shows the clothespin being opened as a result of externally applied compression forces by the thumb and forefinger of a person using the clothespin.

A clothespin 10 has a first elongated member or clothespin arm 12 and a juxtaposed second elongated member or clothespin arm 14, as shown in FIGS. 1–3. A flat spring 16 is completely enclosed within the clothespin structure 10, as seen in FIGS. 2 and 3. As is usual in clothespin devices, the forward end of each clothespin arm 12, 14 is in the form of a gripping jaw 18, 20 formed to clamp clothes or other material objects to a clothesline.

The flat spring 16 is in a generally hairpin shape having an open circular center portion 22 with two divergent legs 24, 26, one extending from each side of the open circular central portion 22. Each said leg portion is so disposed as to press outwardly against the inside rear portion of each clothespin arm thereby to bias the gripping jaws 18, 20 into abutment about a first and second pivot portion 28, 30 disposed respectively on the first and second clothespin arms 12, 14.

Figure 4:
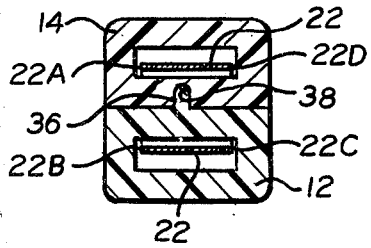
FIG. 4 is a sectional view taken along 4—4 of FIG. 2.

Each of the clothespin arms 12, 14 carries a bridge portion 32, 34 which is generally rectangular in shape and attached at two opposite sides to its respective clothespin arm 12, 14. These two bridge portions 32, 34 are normally pressed together to form a rectangular bridge structure about which the flat spring 16 is disposed as shown in FIG. 4. The open circular center portion 22 of the spring 16 is of predetermined size, with respect to the bridge formed by bridge portions 32, 34, that it only contacts the bridge at four corners. This relationship is shown in FIG. 2, and FIG. 4. Thus, any flexing of the leg portions 24, 26 of the spring 16, will cause the circular portion 22 to be deformed and thereby generate auxiliary forces to resist further flexing. In addition, during deformation, the spring will tightly clamp and hold the bridge adding to the structural stability of the device.

Figure 5:
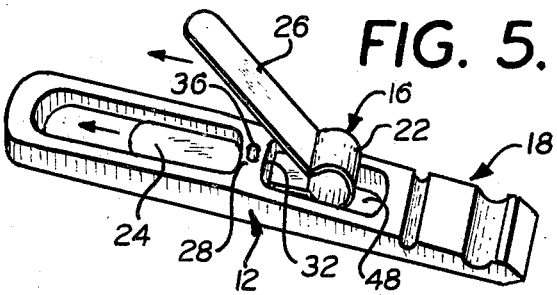
FIG. 5 is a perspective view of a partially disassembled clothespin according to FIG. 1, showing the projection or key structure and a partially inserted spring.

As can be realized from the drawings, especially FIG. 5, the capture of the spring by the bridge formed by bridge portions 32, 34, restrains twisting or other forces which would disassemble the clothespin device. In addition, as can be seen in FIG. 4, as the edge of the spring 22 passes around the bridge 34, it is closely contained and will be further prevented from twisting by contacting the bridge sidewalls with its four edges 22A, 22B, 22C, and 22D. It is also advantageous to provide a recess 40, 42 in each arm 12, 14, of about the same width as the spring, to contain the leg portions 24, 26 of the flat spring 16. This provides greater stability for the clothespin 10 because the flat spring 16 is held, its full length, from moving. In addition, the recesses 40, 42 result in a more completely enclosed spring structure which is safer from snagging and more attractive.

Finally, a key and groove locking mechanism is provided to further restrain and movement of the clothespin arms 12, 14 with respect to each other. The key and groove locking mechanism is disposed forward of the pivot portions 28, 30 to reduce the wear on the locking mechanism. The key, as can be seen in FIG. 4, is a half round projection 36 formed on one clothespin arm 12; and the groove is a half round matching depression or slot 38 formed on the other clothespin arm 14. FIG. 4 shows a rectangular cross-section for the projection 36 and matching groove or slot 38. The straight sides are important in maintaining the relative orientation of the clothespin arms. The side view of the projection (FIG. 5), is semi-circular in shape. This shape facilitates the movement of the projection 36 into and out of the groove 38 as the clothespin 10 is opened and closed, while restraining wear. Both the height and length of the projection are typically about 1/16 of an inch.

The projection 36 and groove 38 are preferably located just ahead of the pivot portions 28, 30, to reduce wear stress on the projection 36 and groove 38.

To provide strength while keeping the weight of material used low, wedge-shaped portions 44, 46 are formed at the gripping jaws 18, 20 respectively. As can be seen in FIG. 3, these wedge-shaped portions 44, 46 extend only partway back from the end of arm 12, 14. This leaves an opening 48 (FIG. 5), 50 (FIG. 1). to facilitate insertion of spring 16 for assembly, as partially shown in FIG. 5.

The preferred embodiment shown herein is intended as an illustration of the type of clothespin that can be formed in accordance with the present invention, which invention is defined in the claims as follows.

What I claim is:

1. In a clothespin of the type including a first elongated member having a forward and a rear end and a first pivot portion intermediate said two ends; a second elongated member having forward and a rear ends and a second pivot portion intermediate said second elongated member two ends; said elongated members pivoting about said pivot portions, said forward end of each said elongated members including a gripping portion operable to grip clothes; and a spring operable to force said elongated members to pivot about said pivot portion and bias said gripping portions into abutment with each other, whereby said gripping portions grip clothes; the improvement comprising:

a first bridge portion including said first pivot portion and having a substantially rectangular shape secured at two opposite sides to said first elongated member in spaced apart relation, a second bridge portion, including said second pivot portion and having a substantially rectangular shape, secured at two opposite sides to said second elongated member in spaced apart relation, said second bridge portion normally abutting said first bridge portion to form, therewith a rectangular bridge;

said spring having a generally hairpin shape with an open circular central portion and a first and a second leg extending therefrom, said circular portion being normally disposed about said bridge with said first leg extending rearwardly toward said first elongated member rear end and said second leg extending rearwardly toward said second elongated member rear end and each being biased outwardly against its respective elongated member, said circular portion being of predetermined diameter to abut said bridge at four edges, only, to restrain relative forward and backward movement of said arms with respect to each other and whereby the pressing together of said elongated members, and therefor said two legs, will deform said circular portion to tightly clamp about said bridge; and a key and groove locking operable to lock said jaws from relative horizontal motion, said key comprising a projection on said first bridging portion disposed forward of said first pivot portion; and a matching groove formed in said second bridging portion forward of said second pivot portion whereby said projection rides in and out of said groove as the members are pivoted, without the pivoting forces being carried by said locking mechanism.

2. The clothespin claimed in claim 1 wherein each said elongated member includes an elongated recess of substantially the same width as said spring, receiving a respective said leg of said spring.

3. The clothespin claimed in claim 2 wherein each arm includes bridge edge portions defined on each side of said bridge and extending perpendicular with respect to said bridge, said spring being of predetermined width at said circular portion to substantially bridge the bridge edge portions thereby preventing twisting of said spring with respect to said bridge portion.

4. The clothespin claimed in claim 2 wherein each said gripping portion includes a reinforcing wedge-shaped portion.

* * * * *